US005118111A

United States Patent [19]

Suitor, deceased et al.

[11] Patent Number: 5,118,111

[45] Date of Patent: Jun. 2, 1992

[54] SPHERICAL PUZZLE

[76] Inventors: Walter Suitor, deceased, late of Tulsa; by Sandra Suitor, executor, 6861 West 35th Pl., Tulsa, both of Okla. 74107

[21] Appl. No.: 714,938

[22] Filed: Jun. 13, 1991

[51] Int. Cl.[5] ..... A63F 9/12

[52] U.S. Cl. ..... 273/160

[58] Field of Search ..... 273/160

[56] References Cited

U.S. PATENT DOCUMENTS

| | | | |
|---|---|---|---|
| 766,444 | 8/1904 | Hoy | 273/160 |
| 1,546,024 | 7/1925 | Reichenbach | 273/160 |
| 2,001,067 | 10/1935 | Lane | 273/153 |
| 3,578,331 | 5/1971 | DeGast | 273/160 X |
| 4,441,715 | 4/1984 | Titus | 273/153 |
| 4,529,201 | 7/1985 | Nadel | 273/153 |
| 4,557,484 | 12/1985 | Sherman, Jr. et al. | 273/153 |
| 4,865,323 | 9/1989 | Heusinkveld | 273/153 |
| 4,877,406 | 10/1989 | Wilk | 434/278 |
| 4,889,340 | 12/1989 | Greene | 273/153 |

*Primary Examiner*—William H. Grieb

*Attorney, Agent, or Firm*—Head & Johnson

[57] ABSTRACT

A spherical puzzle composed of six individual pieces. Each piece has a pair of opposed, convex, arcuate ends. A rectangular prism extends between each pair of arcuate ends. Three of the pieces each have portions removed from the rectangular prism to form a triangular pyramid. Two other pieces each have portions removed from the rectangular prism to form a triangular pyramid with one triangle removed to form a notch. The individual pieces may be assembled and interlocked to form a sphere, whereby the arcuate, convex ends form the exterior of the sphere.

1 Claim, 2 Drawing Sheets

SPHERICAL PUZZLE

BACKGROUND OF THE INVENTION

1. Field of the Invention

The present invention is directed to a puzzle or toy having a plurality of individual pieces that may be assembled in interlocking fashion to form a solid.

2. Prior Art

Various puzzles and toys have been known over the years which are composed of individual pieces which may be assembled to form a solid.

Other three dimensional puzzles having interlocking and rotatable members with elements that slide in relation to each other.

Applicant is aware of the following U.S. Pat. Nos.

| U.S. Pat. No. | INVENTOR |
|---|---|
| 4,557,484 | Sherman, Jr. et al. |
| 4,441,715 | Titus |
| 4,529,201 | Nadel |
| 2,001,067 | Lane |
| 4,865,323 | Heusinkveld |
| 4,877,406 | Wilk |
| 4,889,340 | Greene |

Sherman, Jr. (U.S. Pat. No. 4,557,484) discloses a puzzle having a spherical center support with accompanying circular tracks.

Titus (U.S. Pat. No. 4,441,715) discloses a puzzle having six pieces formed by planes having a common line joining two diametrically opposed poles rotatably fastened together.

Nadel (U.S. Pat. No. 4,529,201) discloses a hollow sphere and members equally spaced about the exterior surface which move about tracks.

Lane (U.S. Pat. No. 2,001,067) discloses a spherical puzzle having an inner ball enclosed by an outer ball with openings which constitute access to the inner ball.

Nothing in the prior art discloses a three dimensional puzzle having a plurality of individual pieces that may be assembled in interlocking fashion to form a solid.

Accordingly, it is a principal object and purpose of the present invention to provide a puzzle having a plurality of individual pieces that may be assembled to interlock and form a solid.

SUMMARY OF THE INVENTION

The present invention includes six separate and distinct pieces which may be assembled to form a solid, in this case, a sphere. When fully assembled, the pieces interlock to form a sphere which will not come apart or disassemble until the pieces are removed.

Each of the individual pieces has a pair of arcuate, convex, opposed ends. Each of the ends is similar in curvature and shape. When assembled, the arcuate ends form the exterior of the sphere.

Each of the six pieces has a rectangular prism that extends longitudinally between the arcuate, convex ends. The six pieces are composed of three distinct configurations. Three pyramid pieces are identical and interchangeable. Each of the three pyramid pieces has a rectangular prism extending between the arcuate, convex ends. Two sides of the rectangular prism have portions removed so that a triangular pyramid is formed between the arcuate ends. Two other notched pieces are identical and interchangeable. Each of the notched pieces has a substantially rectangular prism extending longitudinally between the arcuate ends. Two walls of the rectangular prism have portions removed to form a triangular pyramid. One of the triangles of the pyramid has been removed or cut away so that a V-shaped notch is formed. The V-shaped notch extends from one edge of the rectangular prism to an opposed edge.

The final, remaining, key piece also has a pair of arcuate, convex opposed ends. Extending longitudinally between the arcuate ends is a rectangular prism which is solid, having no portions removed.

In order to assemble the puzzle, the three pyramid pieces are held together so that the faces of the pyramids are aligned and in contact with each other. The two notched pieces will then be assembled with the pyramid pieces so that the notches therein are aligned.

Once these five pieces are held together in place, an opening is formed for receipt of the key piece. The opening is formed from the portions removed from the pyramid pieces and the notches in the notched pieces. The key piece will slide into the opening thus formed and lock the pieces in place.

In order to disassemble the puzzle, the key piece is removed by sliding the key piece out of the opening formed by the notches.

DETAILED DESCRIPTION OF THE PREFERRED EMBODIMENTS

Figure 1:
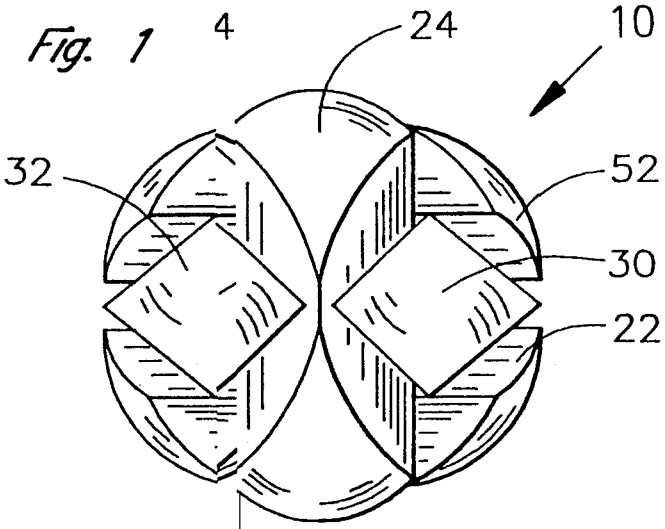
FIG. 1 is a top, perspective view of a fully assembled puzzle constructed in accordance with the present invention.

Referring to the drawings in detail, FIG. 1 illustrates a top view of a puzzle 10 constructed in accordance with the present invention. The puzzle has been fully assembled and in assembled condition forms a solid.

In the present embodiment, the exterior of the puzzle is in the form of a sphere. As the following description will make clear, the exterior shape of the assembled puzzle may take other shapes, such as a cube or a rectangular prism.

The puzzle 10 is comprised of six separate and distinct pieces which may be assembled. The pieces may be constructed of wood, plastic or any sturdy material. When fully assembled, the pieces interlock to form a sphere which will not come apart or disassemble until the pieces are removed. Conversely, until all of the pieces are in place, the pieces will not remain together.

Figure 2:
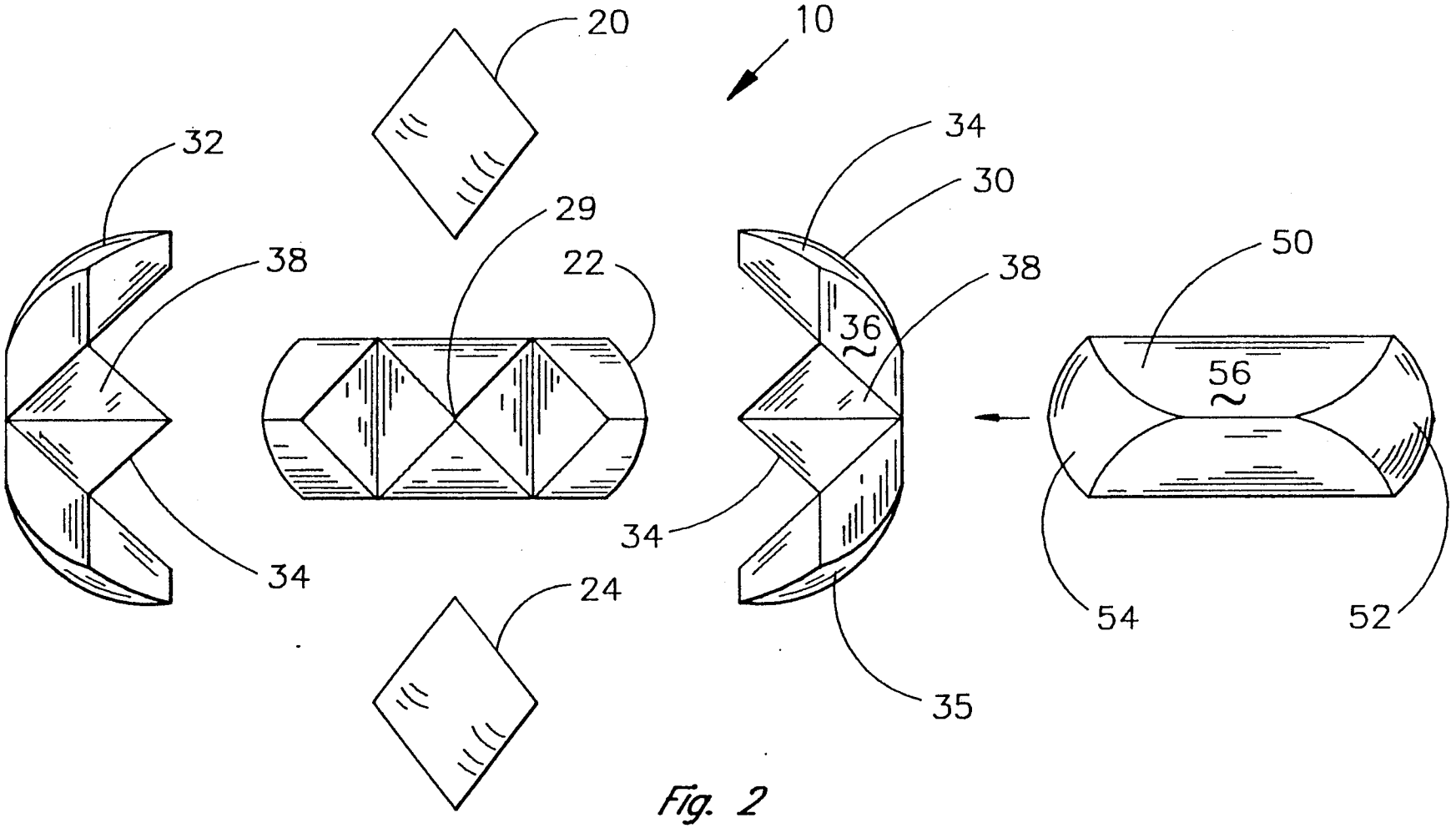
FIG. 2 is a front, exploded view of a puzzle as shown in FIG. 1.

FIG. 2 shows an exploded view of the puzzle 10 showing the individual pieces and their relative positioning. It will be observed that each piece has a pair of arcuate, convex, opposed ends. Each of the ends is similar in curvature and shape. When assembled, the arcuate ends form the exterior of the sphere.

Figure 3:
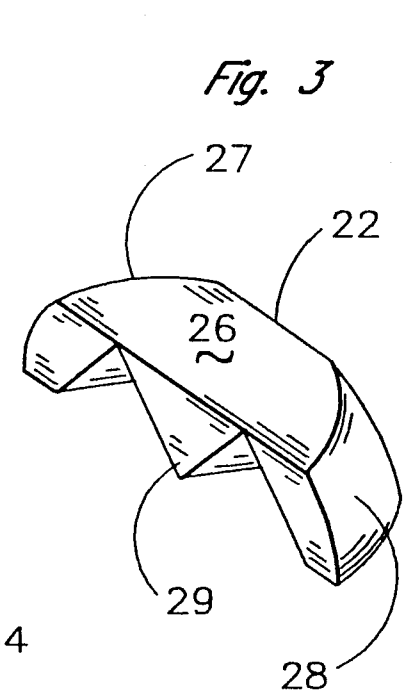
FIG. 3 is a perspective view of a pyramid piece of the puzzle shown in FIG. 1.
Figure 4:
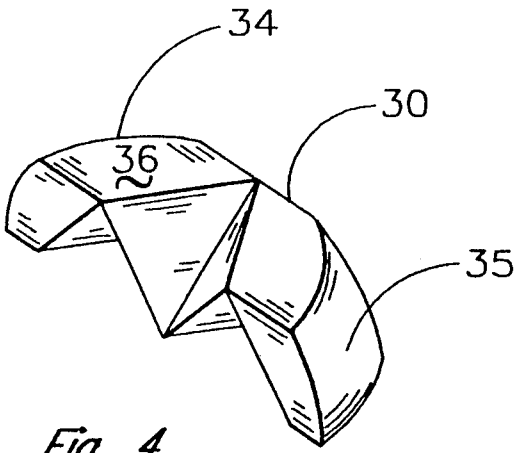
FIG. 4 is a perspective view of a notched piece of the puzzle shown in FIG. 1.
Figure 5:
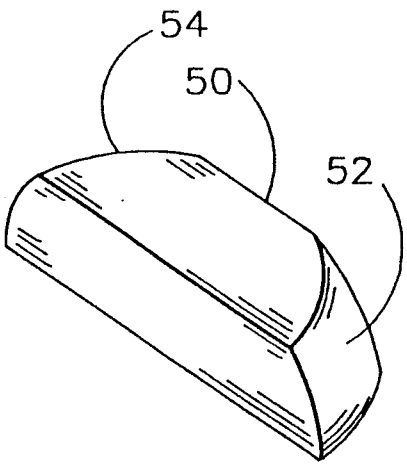
FIG. 5 is a perspective view of a key piece of the puzzle shown in FIG. 1.

As most readily seen in FIGS. 3, 4 and 5, the six pieces which may be assembled to form the puzzle are composed of three distinct configurations. Each of the pieces has a rectangular prism that extends longitudinally between the arcuate, convex ends.

With reference to both FIGS. 2 and continuing reference to FIG. 3, pyramid pieces 20, 22 and 24 are identical and interchangeable. Each of the three pyramid pieces has a rectangular prism 26 which extends longitudinally between the arcuate, convex ends 27 and 28. Two walls or sides of the rectangular prism have portions removed so that a triangular pyramid 29 is formed between the arcuate ends 27 and 28.

Two other pieces 30 and 32 are each identical and interchangeable, as seen in FIG. 4. Each of the pieces 30 and 32 has a rectangular prism 33 extending longitudinally between the arcuate ends 34 and 35. Again, two walls of the rectangular prism 36 have portions removed to form a triangular pyramid 34 between the arcuate ends. One of the triangles of the pyramid 34 has been removed or cut away so that a V-shaped notch 38 is formed. The V-shaped notch extends from one edge of the rectanqular prism to an opposed edge.

The final, remaining piece 50 also has a pair of arcuate, convex opposed ends 52 and 54. Extending longitudinally between the arcuate ends is a rectangular prism 56 which is solid with no portions removed.

While an attempt may be made to assemble the puzzle 10 by guesswork or experiment, a particular procedure will result in a solution. At first glance, the pyramid pieces 20, 22, and 24 appear similar to the notched pieces, although the notches 38 are important.

In order to assemble the puzzle, the three pyramid pieces 20, 22 and 24 will be held together so that the a face of each pyramid 26 will be aligned and in contact with each other. As seen in FIG. 2, piece 22 is perpendicular to pieces 20 and 24.

The notched pieces 30 and 32 will then be assembled with the pyramid pieces 20, 22 and 24 so that the notches 38 are aligned.

Once these five pieces are held together in place, an opening is formed for receipt of the final or key piece 50. The opening is formed from the portions removed from the pyramid pieces 20 and 24 and the notches 38 in notched pieces 30 and 32. The key piece 50 will slide into the opening and locks the pieces in place.

In order to disassemble the puzzle, the key piece 50 is removed by sliding the key piece out of the opening formed by the notches in the notched pieces 30 and 32. Once this has been done, the remaining pieces will simply and quickly disassemble.

From the foregoing description, it will be observed that the pieces interlock and no fasteners are required to hold the pieces together.

The order of assembly of the pieces is generally unimportant except that the key piece must be inserted last during assembly and removed first in disassembly.

Whereas, the present invention has been described in relation to the drawings attached hereto, it should be understood that other and further modifications, apart from those shown or suggested herein, may be made within the spirit and scope of this invention.

What is claimed is:

1. A puzzle which comprises: six rectangular prism pieces which interlock to form a solid, each piece having a pair of opposed, convex, arcuate ends, said pieces consisting of three identical and interchangeable pyramid pieces having portions removed to form a triangular pyramid, and two other identical and interchangeable notch pieces having portions removed to form a triangular pyramid with one triangle removed to form a notch, and a key piece which may be received in the said notches formed in the two said notch pieces having one triangle removed from said triangular pyramid.

* * * * *